US012305880B2

(12) United States Patent
Gong et al.

(10) Patent No.: US 12,305,880 B2
(45) Date of Patent: May 20, 2025

(54) AIR CONDITIONER

(71) Applicant: GD MIDEA AIR-CONDITIONING EQUIPMENT CO., LTD., Guangdong (CN)

(72) Inventors: Sun Gong, Guangdong (CN); Zhiyao Zhong, Guangdong (CN); Jielin Peng, Guangdong (CN)

(73) Assignee: GD MIDEA AIR-CONDITIONING EQUIPMENT CO., LTD., Guangdong (CN)

( * ) Notice: Subject to any disclaimer, the term of this patent is extended or adjusted under 35 U.S.C. 154(b) by 441 days.

(21) Appl. No.: 17/695,921

(22) Filed: Mar. 16, 2022

(65) Prior Publication Data

US 2022/0205678 A1 Jun. 30, 2022

Related U.S. Application Data

(63) Continuation of application No. PCT/CN2019/120708, filed on Nov. 25, 2019.

(30) Foreign Application Priority Data

Sep. 19, 2019 (CN) ..... 201910889102.6
Sep. 19, 2019 (CN) ..... 201921568922.7

(51) Int. Cl.

| | |
|---|---|
| ***F24F 13/20*** | (2006.01) |
| ***F24F 1/0014*** | (2019.01) |
| ***F24F 7/04*** | (2006.01) |
| ***F24F 13/12*** | (2006.01) |

(52) U.S. Cl.

CPC ..... *F24F 13/20* (2013.01); *F24F 7/04* (2013.01)

(58) Field of Classification Search

None

See application file for complete search history.

(56) References Cited

U.S. PATENT DOCUMENTS 5,782,688 A * 7/1998 Baek ..... F24F 1/0011 454/324

FOREIGN PATENT DOCUMENTS

| | | | | |
|---|---|---|---|---|
| CN | 103776092 | A | | 5/2014 |
| CN | 103776094 | A | * | 5/2014 |
| CN | 104006518 | A | | 8/2014 |
| CN | 105423420 | A | | 3/2016 |
| CN | 107429936 | A | | 12/2017 |
| CN | 208108277 | U | * | 11/2018 |
| CN | 208139434 | U | | 11/2018 |
| CN | 109812869 | A | | 5/2019 |

(Continued)

OTHER PUBLICATIONS

Chen, CN103776094 (Year: 2014).*

(Continued)

*Primary Examiner* — Steven S Anderson, II

(74) *Attorney, Agent, or Firm* — Scully, Scott, Murphy & Presser, P.C.

(57) ABSTRACT

An air conditioner is provided. The air conditioner has a housing and a door panel. The housing is provided with an air inlet and a front air outlet. The front air outlet has a first air outlet and a second air outlet. The door panel is slidably arranged on the outer side of the housing. The door panel has at least one position where the door panel simultaneously shields a part of the first air outlet and a part of the second air outlet.

11 Claims, 12 Drawing Sheets

(56) References Cited

FOREIGN PATENT DOCUMENTS

| | | | | |
|---|---|---|---|---|
| CN | 208832683 | U | | 5/2019 |
| CN | 109945311 | A | | 6/2019 |
| CN | 109959074 | A | | 7/2019 |
| CN | 109974084 | A | | 7/2019 |
| CN | 109974085 | A | | 7/2019 |
| CN | 110173760 | A | | 8/2019 |
| CN | 211345539 | U | | 8/2020 |
| KR | 2010086313 | A | * | 7/2010 |
| KR | 20100086313 | A | | 7/2010 |
| KR | 20120064492 | A | | 6/2012 |
| KR | 101392315 | B1 | | 5/2014 |
| KR | 20160051095 | A | * | 5/2016 |

OTHER PUBLICATIONS

Zhong, CN208108277 (Year: 2018).*
Gang, KR2010086313 (Year: 2010).*
Chun, KR20160051095 (Year: 2016).*
Request for the Submission of an Opinion dated Nov. 27, 2023 received in Korean patent Application No. KR 10-2022-7008662.
International Search Report dated Jun. 18, 2020 issued in PCT/CN2019/120708.
Chinese Office Action dated Dec. 31, 2024 for Chinese Patent Application No. 201910889102.6.

* cited by examiner

A-A

FGI. 9

AIR CONDITIONER

CROSS-REFERENCE TO RELATED APPLICATIONS

The present application is a continuation applications of PCT International Application No. PCT/CN2019/120708, filed on Nov. 25, 2019, which claims priority to and benefit of Chinese Patent Application Nos. 201910889102.6 and 201921568922.7, field on Sep. 19, 2019, the entire contents of which are incorporated herein by reference for all purposes. No new matter has been introduced.

FIELD

The present disclosure relates to the field of household appliances and, more particularly, to an air conditioner.

BACKGROUND

An air conditioner includes an air outlet for air discharge and a door panel for opening and closing the air outlet in a housing of the air conditioner. The door panel of the air conditioner in the related art is arranged inside the housing, and when the air conditioner is running, the door panel moves inside the housing to open the air outlet, and when the air conditioner stops running, the door panel moves in a reverse direction inside the housing to close the air outlet. The door panel arranged inside the housing occupies space inside the housing, resulting in a tight layout inside the housing and a complex structure inside the housing.

SUMMARY

The present disclosure aims to solve at least one of the technical problems existing in the related art. To this end, an objective of the present disclosure is to provide an air conditioner, in which a door panel is slidably arranged on an outer side of a housing, saving space inside the housing and simplifying an internal structure of the housing, and in which a front air outlet includes a first air outlet and a second air outlet, allowing for a wider air output range of the air conditioner.

The air conditioner according to certain embodiments of the present disclosure includes: a housing including an air inlet and a front air outlet, the front air outlet including a first air outlet and a second air outlet; and a door panel slidably arranged on an outer side of the housing. There is at least one position where the door panel shields a part of the first air outlet and a part of the second air outlet simultaneously.

For the air conditioner according to certain embodiments of the present disclosure, by making the door panel slidably arranged on the outer side of housing, space inside the housing can be saved and an internal structure of the housing is simplified; by making the front air outlet include the first air outlet and the second air outlet, the air output range of the air conditioner is enlarged.

In addition, the air conditioner according to certain embodiments of the present disclosure has the following additional technical features.

According to an embodiment of the present disclosure, the door panel includes a sliding groove, the housing includes a sliding shaft, and the sliding shaft is slidably fitted in the sliding groove.

According to an embodiment of the present disclosure, the second air outlet is arranged to surround the first air outlet.

According to an embodiment of the present disclosure, the housing further includes a top air outlet, a first air duct and a second air duct, and a first blower and a second blower. The top air outlet is arranged above the front air outlet, and the top air outlet is slidable in a sliding direction of the door panel. The first air duct and the second air duct are arranged within the housing. The first air duct communicates the air inlet with the first air outlet, and the second air duct communicates the air inlet with the second air outlet and communicates the air inlet with the top air outlet. The first blower is arranged within the first air duct, and the second blower is arranged within the second air duct.

According to an embodiment of the present disclosure, the sliding groove include two first sliding sub-grooves and two second sub-grooves, the two first sliding sub-grooves are spaced apart from each other on the door panel and have opposite opening directions, and the two second sliding sub-grooves are spaced apart from each other on the door panel and have opposite opening directions. The sliding shaft includes two first sliding sub-shafts and two second sliding sub-shafts, the two first sliding sub-shafts are spaced apart from each other on the housing and fitted in the two first sliding sub-grooves in one-to-one correspondence, and the two second sliding sub-shafts are spaced apart from each other on the housing and fitted in the two second sliding sub-grooves in one-to-one correspondence.

According to an embodiment of the present disclosure, the two second sliding sub-grooves are arranged between the two first sliding sub-grooves, and the two second sliding sub-grooves are coupled to the two first sliding sub-grooves in one-to-one correspondence; and a length of the first sliding sub-grooves and the second sliding sub-grooves as a whole in a sliding direction of the door panel is L, a length of the first sliding sub-grooves in the sliding direction of the door panel is L1, and a length of the second sliding sub-grooves in the sliding direction of the door panel is L2, in which L is greater than L1 and L is greater than L2.

According to an embodiment of the present disclosure, the first sliding sub-grooves and the second sliding sub-grooves extend in an up-down direction, with an upper end of each second sliding sub-groove being lower than an upper end of each first sliding sub-groove and a lower end of each second sliding sub-groove being lower than a lower end of each first sliding sub-groove.

According to an embodiment of the present disclosure, the sliding groove includes a straight groove segment and a first curved groove segment, a first end of the first curved groove segment being coupled to a first end of the straight groove segment, and a second end of the first curved groove segment being bent and extending in a direction away from the housing. The sliding groove further includes a second curved groove segment, a first end of the second curved groove segment being coupled to a second end of the straight groove segment, and a second end of the second curved groove segment being bent and extending in the direction away from the housing.

According to an embodiment of the present disclosure, a driving mechanism is arranged between the housing and the door panel and drives the door panel to slide. The driving mechanism includes a rack and a gear, and a driving motor. The rack and the gear engage each other. The rack extends along a sliding direction of the door panel and is coupled to the door panel. The gear is coupled to the housing. The driving motor is coupled to the gear and drives the gear to rotate.

According to an embodiment of the present disclosure, each side of the rack includes an engagement portion. The gear includes a first gear and a second gear arranged on a respective side of the rack. The first gear and the second gear are engaged with their corresponding engagement portions, respectively.

According to an embodiment of the present disclosure, the driving mechanism further includes a support frame coupled to the housing; the support frame has a motor mounting position, and the driving motor is mounted in the motor mounting position; and the support frame includes a limit slot, and the rack is slidably fitted in the limit slot.

According to an embodiment of the present disclosure, the driving mechanism is located on an inner side of the housing; the housing includes a window, and the window extends through the housing in a thickness direction of the housing; and the door panel is coupled to the driving mechanism through the window, and the door panel is configured to seal the window.

According to an embodiment of the present disclosure, the sliding groove includes a straight groove segment and a first curved groove segment, a first end of the first curved groove segment being coupled to a first end of the straight groove segment, and a second end of the first curved groove segment being bent and extending in a direction away from the housing; and the driving mechanism further includes a connecting member articulated between the door panel and the rack.

Additional aspects and advantages of embodiments of present disclosure will be given in part in the following descriptions, become apparent in part from the following descriptions, or be learned from the practice of the embodiments of the present disclosure.

BRIEF DESCRIPTION OF DRAWINGS

These and/or other aspects and advantages of embodiments of the present disclosure will become apparent and more readily appreciated from the following descriptions made with reference to the drawings, in which.

Figure 1:
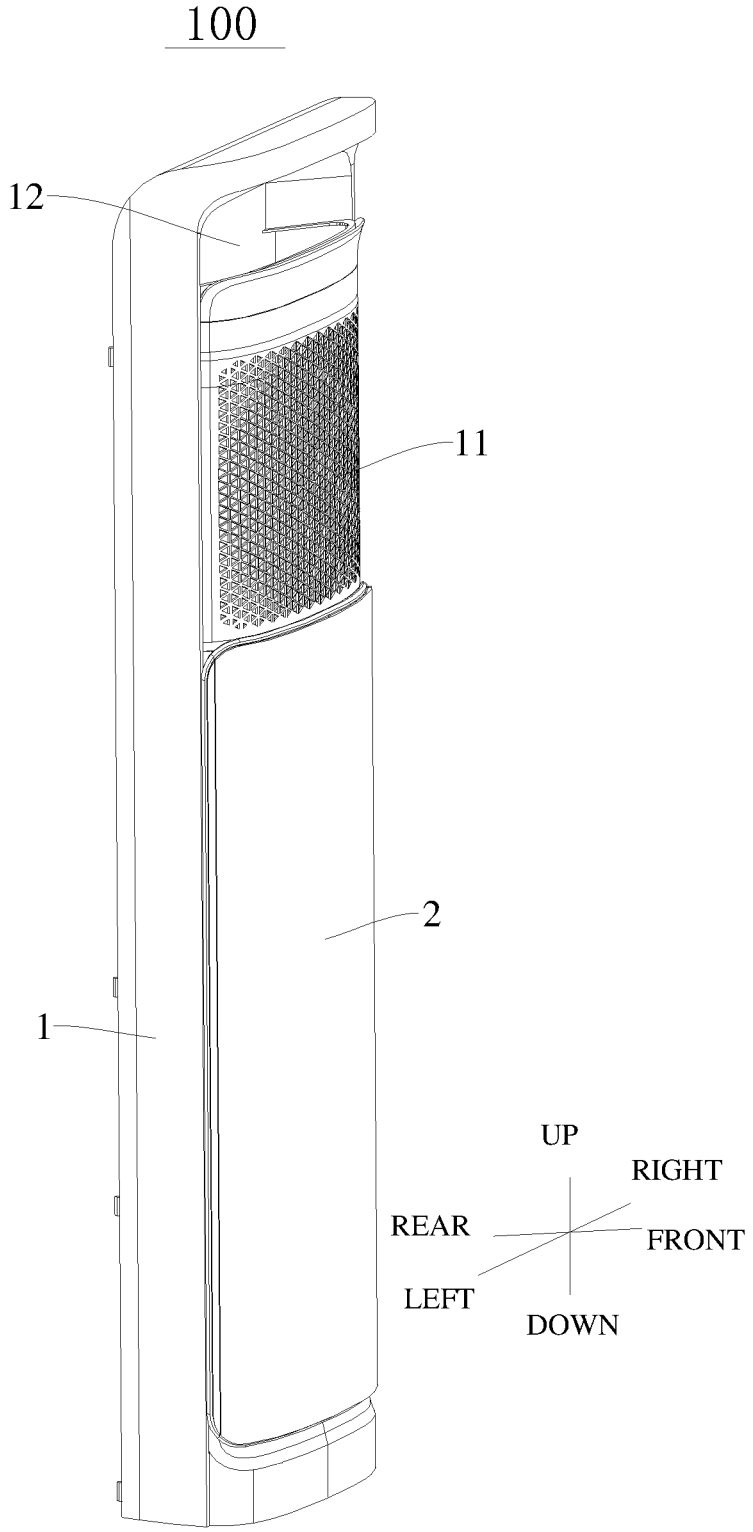
FIG. 1 is a perspective view of an air conditioner according to an embodiment of the present disclosure (only illustrating a part of a structure of a housing), in which a door panel opens a front air outlet.
Figure 2:
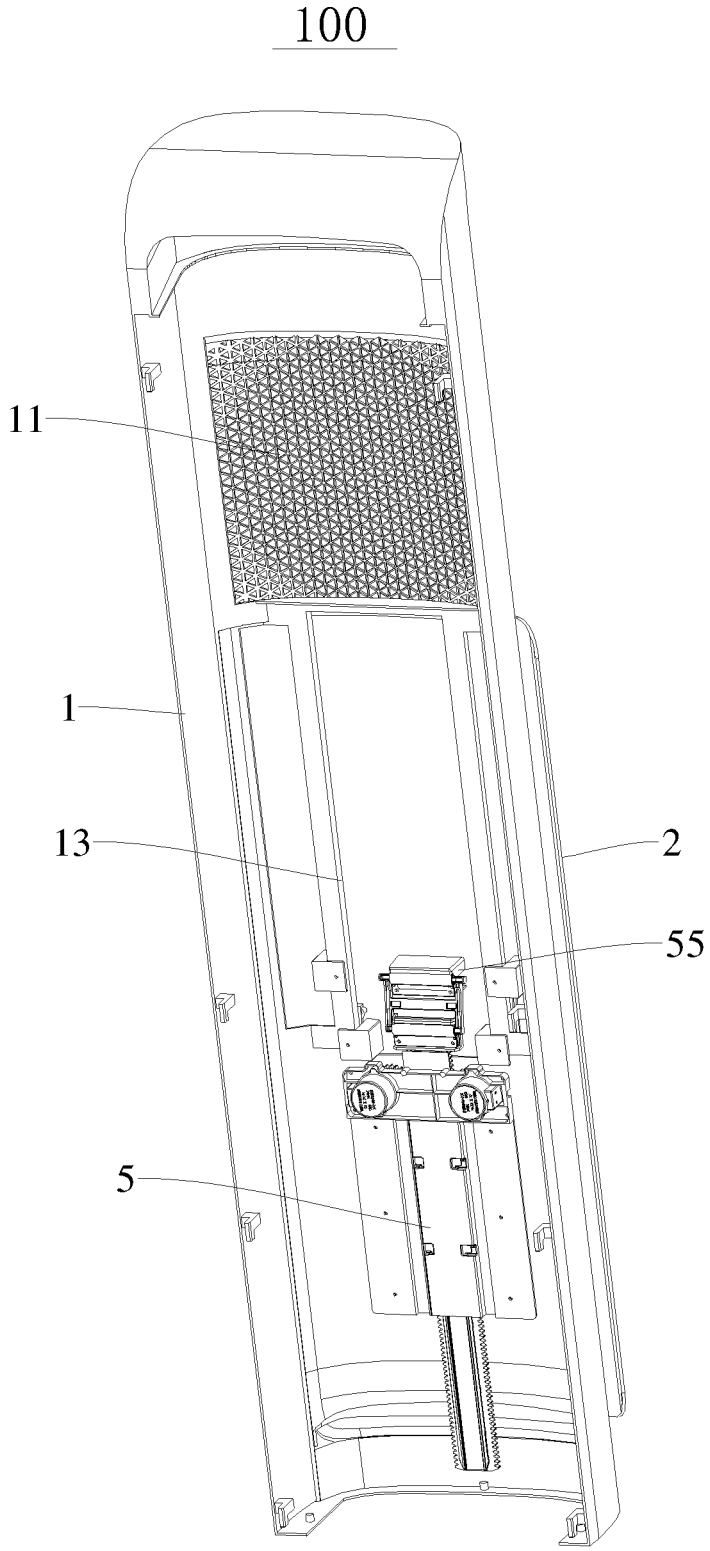
FIG. 2 is a perspective view of the air conditioner in FIG. 1 from another angle.
Figure 3:
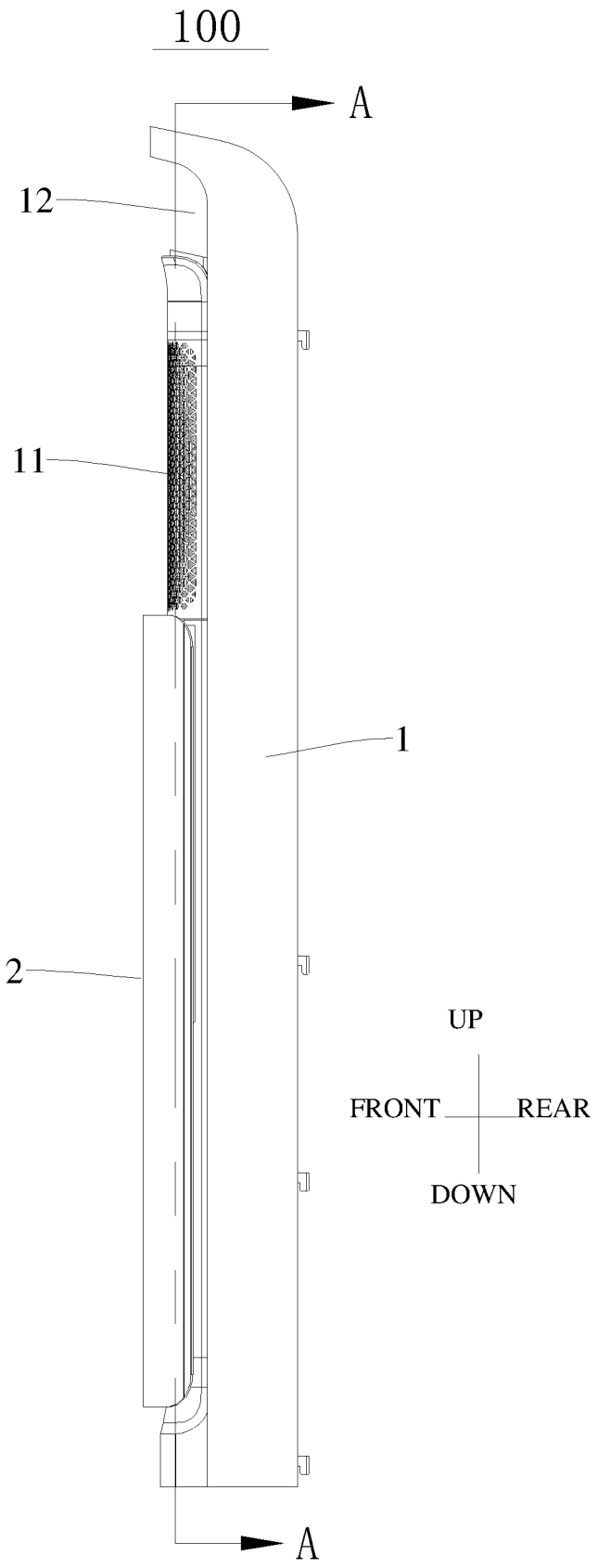
FIG. 3 is a right view of the air conditioner in FIG. 1.
Figure 4:
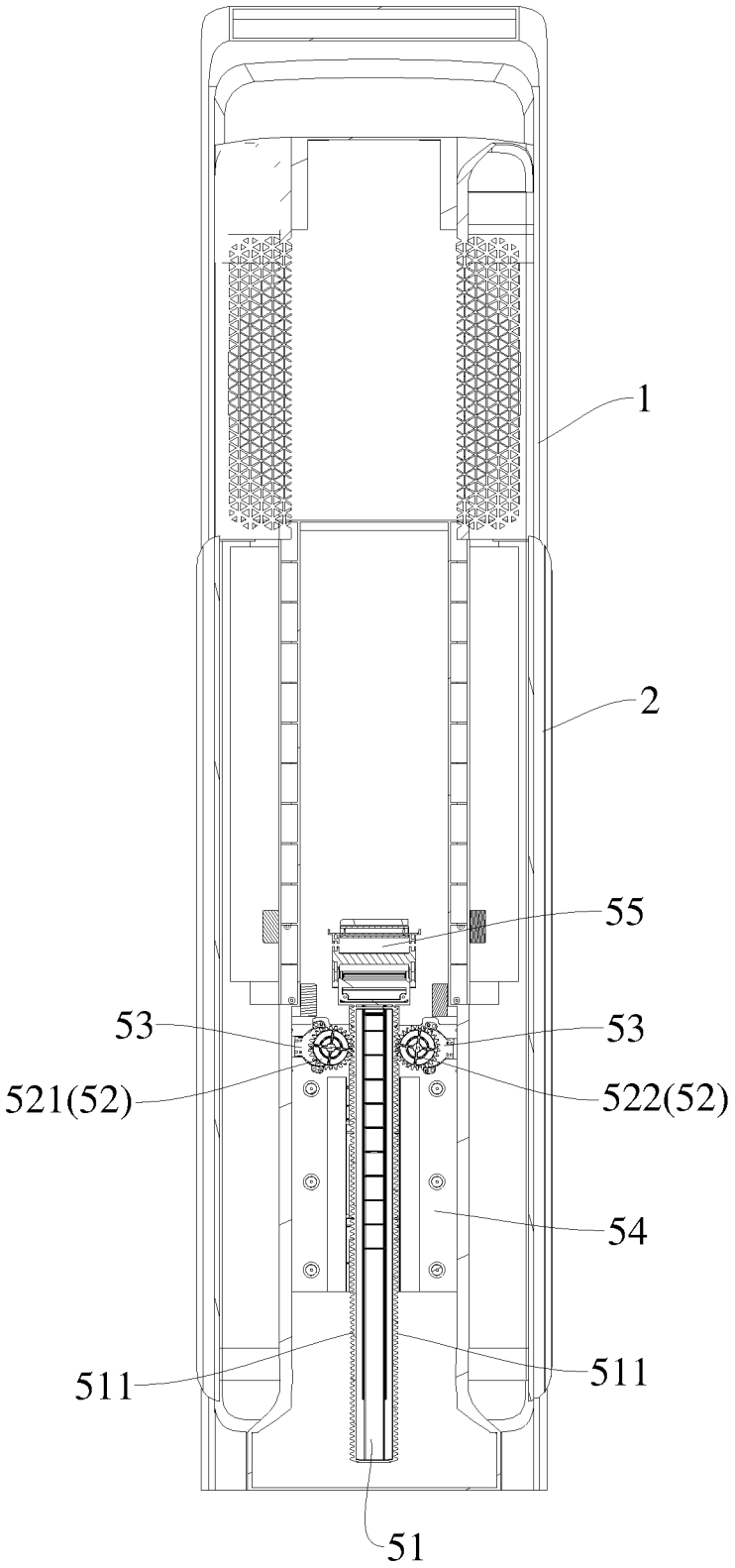
FIG. 4 is a sectional view of the air conditioner in FIG. 1 along line A-A in FIG. 3.

The reference numerals shown in the figures are described as follows:

air conditioner 100;
housing 1; front air outlet 11; top air outlet 12; window 13;
door panel 2;
sliding groove 3; first sliding sub-groove 31; second sliding sub-groove 32; straight groove segment 33; first curved groove segment 34; second curved groove segment 35;
sliding shaft 4; first sliding sub-shaft 41; second sliding sub-shaft 42; mounting base 43;
driving mechanism 5; rack 51; engagement portion 511; gear 52; first gear 521; second gear 522;
driving motor 53;
support frame 54; motor mounting position 541; limit slot 542;
connecting member 55.

DETAILED DESCRIPTION OF EMBODIMENTS

Embodiments of the present disclosure will be described below in detail, and examples of the embodiments are illustrated in the accompanying drawings, where the same or similar reference numerals throughout the specification refer to the same or similar elements or elements having the same or similar functions. The embodiments described below with reference to the accompanying drawings are exemplary and are intended to explain the present disclosure rather than limit the present disclosure.

An air conditioner 100 according to certain embodiments of the present disclosure will be described below with reference to FIGS. 1-12.

Referring to FIGS. 1-4 and FIG. 12, the air conditioner 100 according to an embodiment of the present disclosure includes: a housing 1 and a door panel 2.

The housing 1 has an air inlet and a front air outlet 11, and the front air outlet 11 includes a first air outlet and a second air outlet. Indoor air enters the housing 1 through the air inlet and is discharged via the front air outlet 11 after heat exchange. The air after heat exchange can be discharged through the first air outlet or through the second air outlet. Since the front air outlet 11 includes the first air outlet and the second air outlet, an air output range of the air conditioner 100 is enlarged. The enlarged air output range of the air conditioner improves an air-conditioning effect on the indoor air.

The door panel 2 is slidably arranged on an outer side of the housing 1. There is at least one position where the door panel 2 shields both a part of the first air outlet and a part of the second air outlet, thereby facilitating control over the opening and closing of the first air outlet and the second air outlet. For example, as shown in FIGS. 1-4 and FIG. 11, the door panel 2 is arranged on the outer side of the housing 1 and is slidable in an up-down direction. When the door panel 2 slides downwards (as shown in FIGS. 1-4), the door panel 2 opens the first air outlet and the second air outlet, and when the door panel 2 slides upwards (as shown in FIG. 12), the door panel 2 closes the first air outlet and the second air outlet.

For the air conditioner 100 according to this exemplary embodiment of the present disclosure, by slidably arranging the door panel 2 on the outer side of housing 1, space inside the housing 1 can be saved and an internal structure of the housing 1 is simplified; by making the front air outlet 11 include the first air outlet and the second air outlet, the air output range of the air conditioner 100 is enlarged.

In an embodiment of the present disclosure, the second air outlet is arranged to surround the first air outlet, and an outer edge of the front air outlet 11 corresponds to an outer edge of the second air outlet. By making the second air outlet surround the first air outlet, the air conditioner 100 has a wider air output range and a better air output effect. In some examples of the present disclosure, an outer contour of the first air outlet is formed as a circle and an outer contour of the second air outlet is formed as a rectangle.

Figure 11:
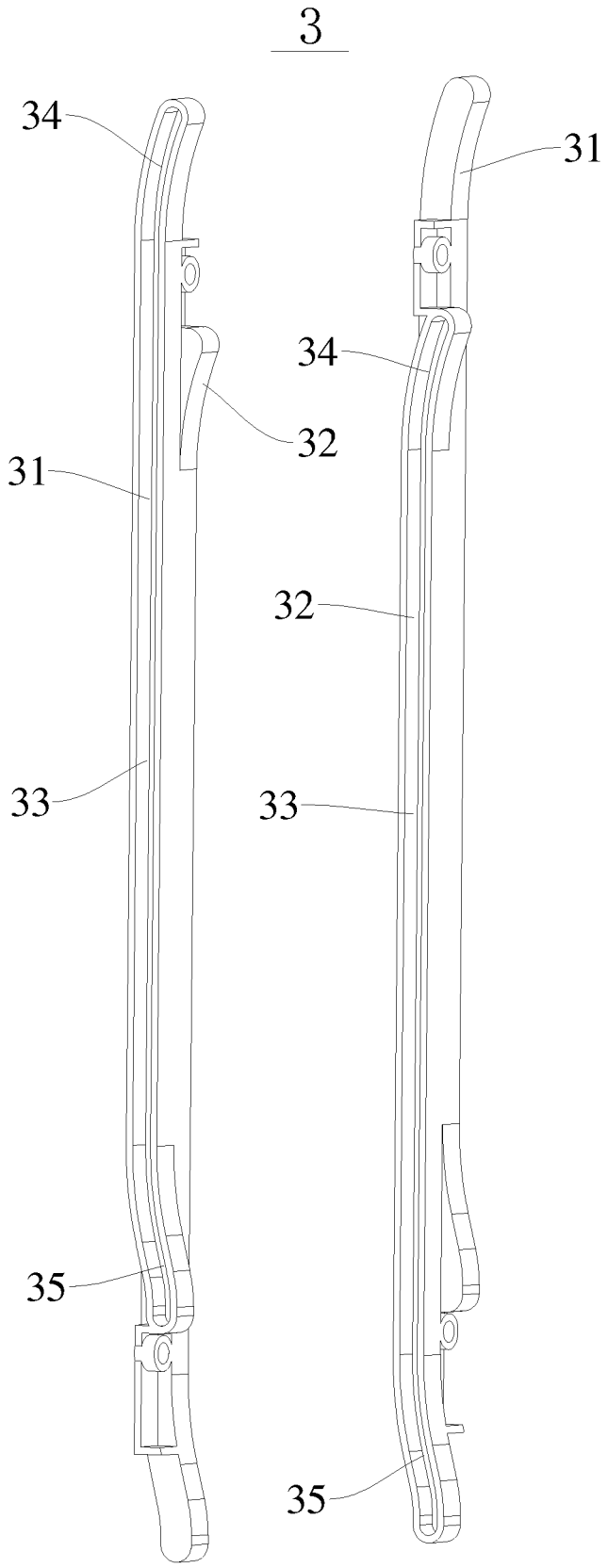
FIG. 11 is a schematic view of a sliding groove of an air conditioner according to an embodiment of the present disclosure.
Figure 12:
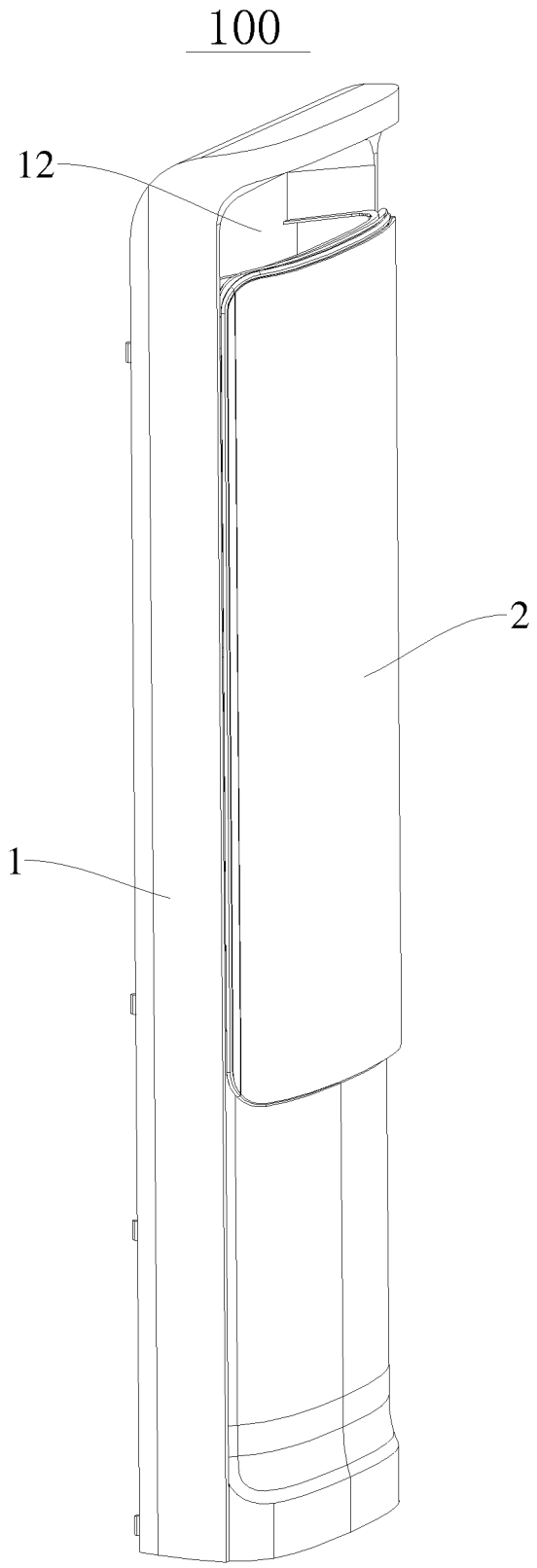
FIG. 12 is a perspective view of an air conditioner according to an embodiment of the present disclosure (only illustrating a part of a structure of a housing), in which a door panel closes a front air outlet.

In an embodiment of the present disclosure, as shown in FIGS. 1-4 and in FIG. 12, the housing 1 also has a top air outlet 12 arranged above the front air outlet 11, and the top air outlet 12 is slidable in a direction of the door panel 2. In an exemplary example shown in FIGS. 1-4 and FIG. 11, the door panel 2 slides in the up-down direction and the top air outlet 12 is also slidable in the up-down direction. When the top air outlet 12 slides downwards, the top air outlet 12 is hidden inside the housing 1 and the top air outlet 12 is closed, in which case no air is outputted from the top air outlet 12. When the top air outlet 12 slides upwards, the top air outlet 12 extends out of the housing 1 to reveal itself outside the housing 1 and the top air outlet 12 is opened, in which case air can be outputted from the top air outlet 12. By arranging the top air outlet 12 on the housing 1, the air inside the housing 1 can be discharged through the front air outlet 11 and also through the top air outlet 12 after heat exchange, enlarging the air output range of the air conditioner 100.

An air output direction of the top air outlet 12 can be selected as desired, for example, towards the front, the rear, the left, the right or the top. In some examples of the present disclosure, as shown in FIGS. 1-4 and FIG. 12, the front air outlet 11 and the top air outlet 12 are both formed on a front panel of the housing 1, and both output air forwards, with a short air supply distance and a good cooling or heating effect.

A height of the front air outlet 11 and a height of the top air outlet 12 can be selected as desired. In some examples of the present disclosure, the height of the front air outlet 11 is suitable for a height of a human body, and air output from the front air outlet 11 may blow directly to an area where the human body is; the height of the top air outlet 12 is higher than the height of the human body, air output from the top air outlet 12 blows above the human body, and then the airflow naturally sinks to the area where the human body is, at which time the human body will not feel wind or may feel light wind, enhancing user comfort.

The opening and closing of the front air outlet 11 can be controlled by sliding the door panel 2 up and down, and the opening and closing of the top air outlet 12 can be controlled by hiding the top air outlet 12 inside the housing or revealing itself outside the housing 1. A variety of air supply modes may be realized by controlling the opening and closing of the front air outlet 11 and the top air outlet 12.

Mode 1:

The front air outlet 11 is open and the top air outlet 12 is open, so that both the front air outlet 11 and the top air outlet 12 supply air, in which case the air-supplying effect is good, and the cooling or heating effect is good.

When an indoor temperature is detected to reach a preset temperature threshold, the front air outlet 11 is closed, and only the top air outlet 12 supplies air, achieving a windless sensation and temperature balance.

Mode 2:

The front air outlet 11 is open and the top air outlet 12 is closed, so that only the front air outlet 11 outputs air, in which case the air supply distance is short and a dehumidification effect is better.

When the indoor temperature is detected to reach the preset temperature threshold, the front air outlet 11 is closed and the top air outlet 12 is open, i.e., only the top air outlet 12 outputs air, so that the air conditioner 100 supplies air from above the human body. As cold air naturally sinks, the human body may not feel wind or may feel light wind, providing comfort to the human body.

Mode 3:

The front air outlet 11 is open and the top air outlet 12 is closed, so that only the front air outlet 11 outputs air, in which case the air supply distance is short and the dehumidification effect is better.

When a user is detected at the front air outlet 11, the front air outlet 11 is closed and the top air outlet 12 is opened; at this time, only the top air outlet 12 outputs air, preventing cold air from blowing directly to the human body, and preventing the user from feeling uncomfortable.

Further, a first air duct and a second air duct are arranged within the housing 1. The first air duct communicates the air inlet with the first air outlet. The second air duct communicates the air inlet with the second air outlet and communicates the air inlet with the top air outlet 12. A first blower is arranged within the first air duct, and a second blower is arranged within the second air duct. A heat exchanger is arranged within the housing 1 and located on an upstream side of the first air duct and the second air duct, so that air from the air inlet enters the first air duct and the second air duct after heat exchange. It should be noted that the "upstream side" herein is based on a flow direction of the air within the housing 1. For example, when the first blower is in operation, the indoor air is driven by the first blower and enters the housing 1 through the air inlet to exchange heat with the heat exchanger, and the air after the heat exchange enters the first air duct and flows through the first air duct towards the first air outlet, so that the air after the heat exchange is discharged through the first air outlet. When the second blower is in operation, the indoor air is driven by the second blower and enters the housing 1 through the air inlet to exchange heat with the heat exchanger, and the air after the heat exchange enters the second air duct and flows through the second air duct towards the second air outlet and the top air outlet 12, so that the air after the heat exchange is discharged through the second air outlet and the top air outlet 12. In some examples of the present disclosure, both the first blower and the second blower may operate when the air conditioner 100 is in operation; or in some examples of the present disclosure, only one of the first blower and the second blower operates when the air conditioner 100 is in operation. By providing the first air duct and the second air duct within the housing 1, an air duct heat exchange area is greatly increased, the air conditioner 100 has a better cooling or heating effect, and the performance of the air conditioner 100 is improved.

In an embodiment of the present disclosure, as shown in FIGS. 5-10, the door panel 2 includes a sliding groove 3, the housing 1 includes a sliding shaft 4, and the sliding shaft 4 is slidably fitted in the sliding groove 3. The fit between the sliding groove 3 and the sliding shaft 4 can guide the sliding of the door panel 2 on the housing 1, thereby guiding the door panel 2 to open or close the front air outlet 11.

Further, as shown in FIGS. 5-11, the sliding groove 3 includes two first sliding sub-grooves 31 and two second sliding sub-grooves 32. The two first sliding sub-grooves 31 are spaced apart from each other on the door panel 2, and the two first sliding sub-grooves 31 have opposite opening directions. The two second sliding sub-grooves 32 are spaced apart from each other on the door panel 2, and the two second sliding sub-grooves 32 have opposite opening directions. The sliding shaft 4 includes two first sliding sub-shafts 41 and two second sliding sub-shafts 42. The two first sliding sub-shafts 41 are spaced apart from each other on the housing 1, and the two first sliding sub-shafts 41 are fitted in the two first sliding sub-grooves 31 in one-to-one correspondence. The two second sliding sub-shafts 42 are spaced apart from each other on the housing 1, and the two second sliding sub-shafts 42 are fitted in the two second sliding sub-grooves 32 in one-to-one correspondence. By the fit between the two first sliding sub-grooves 31 and the two first sliding sub-shafts 41 and the fit between the two second sliding sub-grooves 32 and the two second sliding sub-shafts 42, and with the opposite opening directions of the two first sliding sub-grooves 31 and the opposite opening directions of the two second sliding sub-grooves 32, the sliding of the door panel 2 on the housing 1 is more smoothly and reliable.

Figure 5:
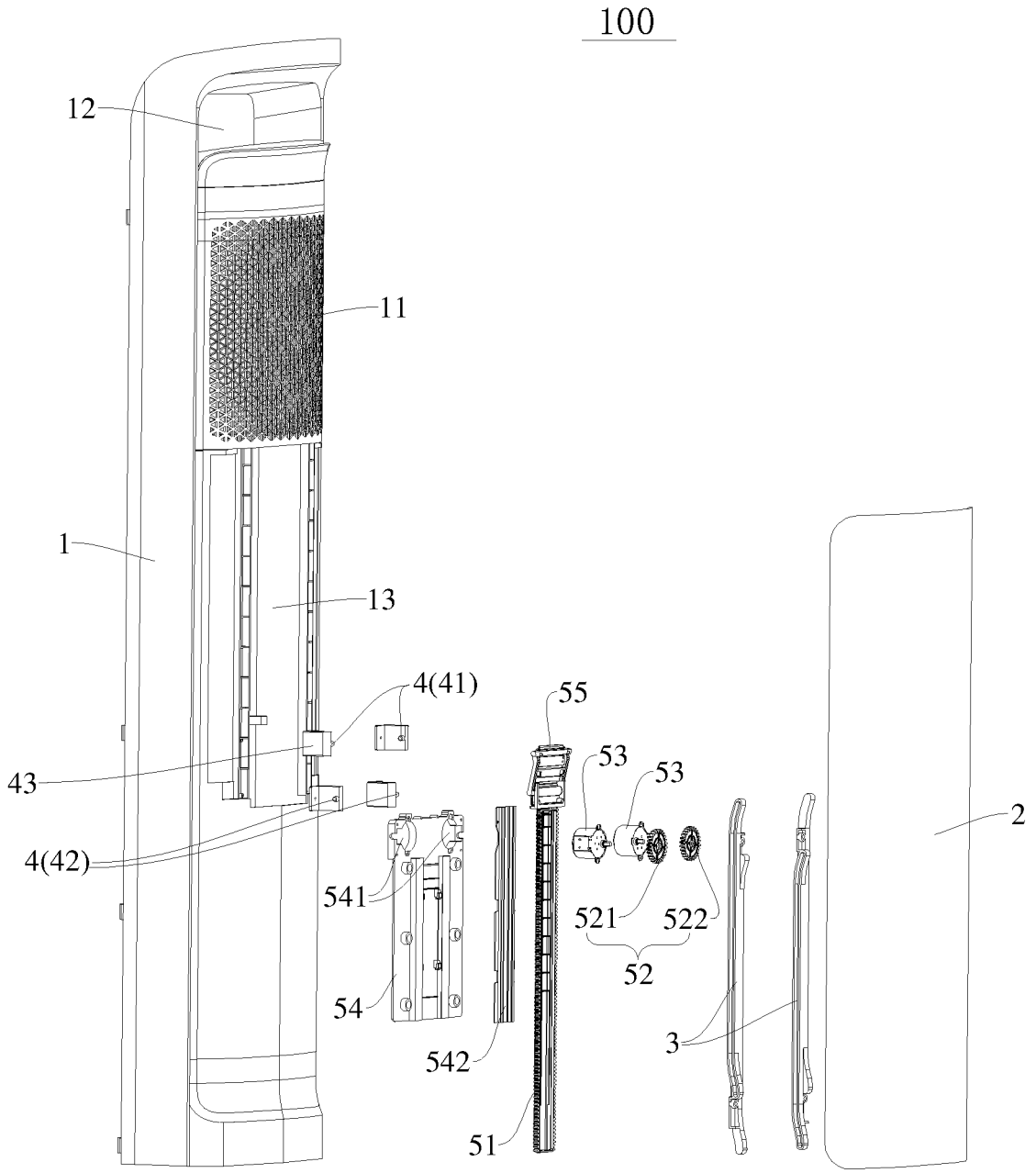
FIG. 5 is an exploded view of the air conditioner in FIG. 1.
Figure 6:
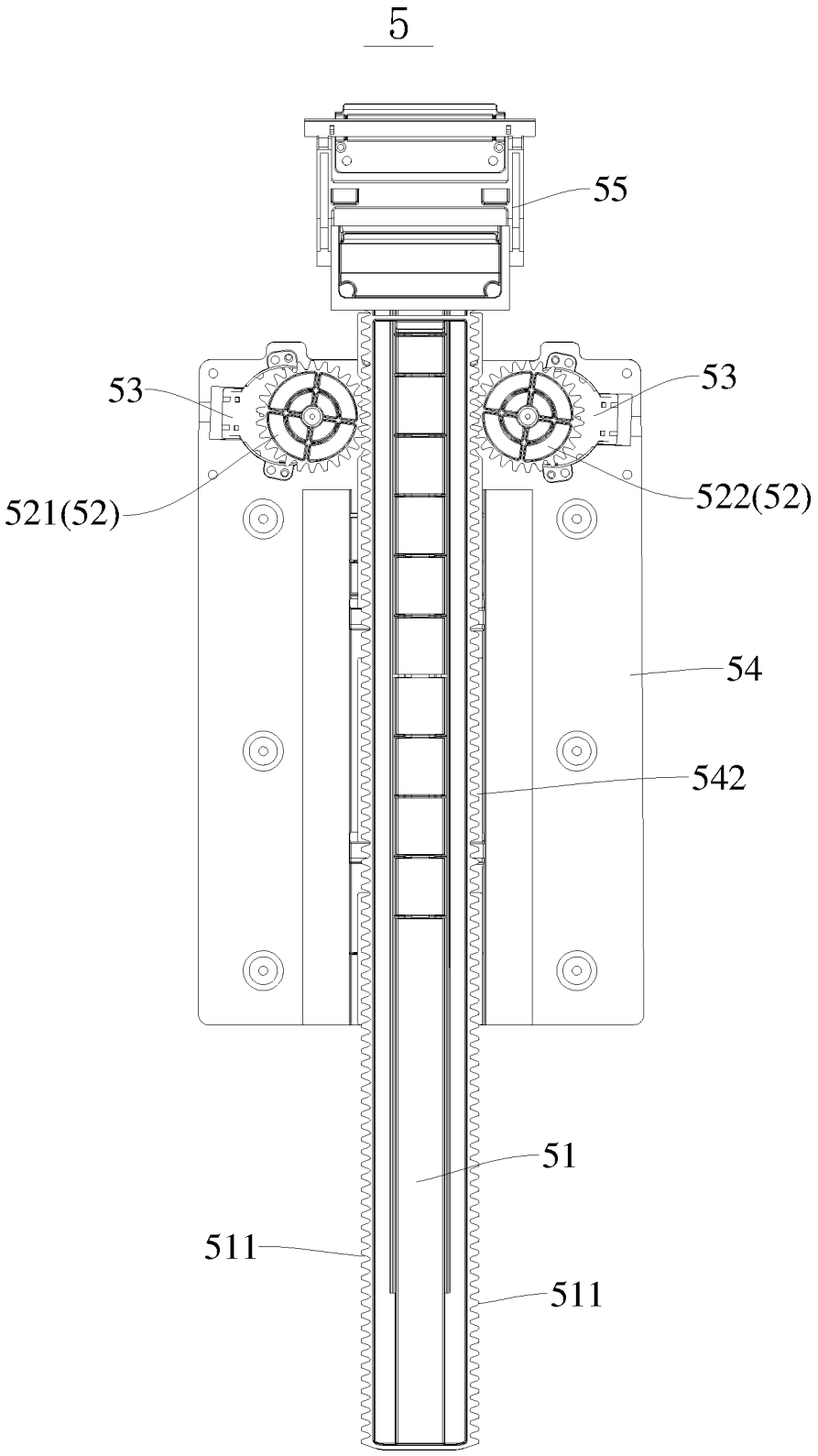
FIG. 6 is a front view of a driving mechanism of an air conditioner according to an embodiment of the present disclosure.
Figure 7:
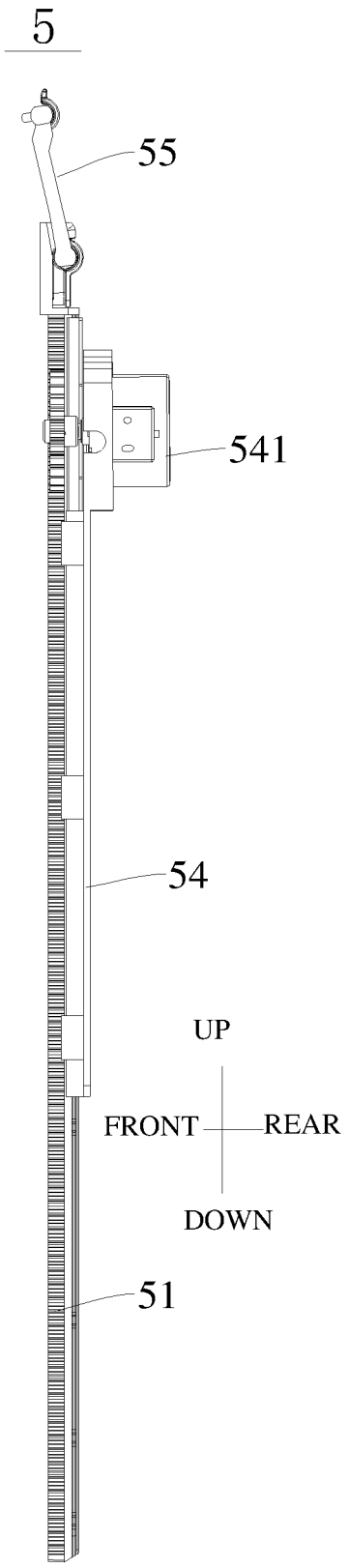
FIG. 7 is a right view of the driving mechanism in FIG. 6.
Figure 8:
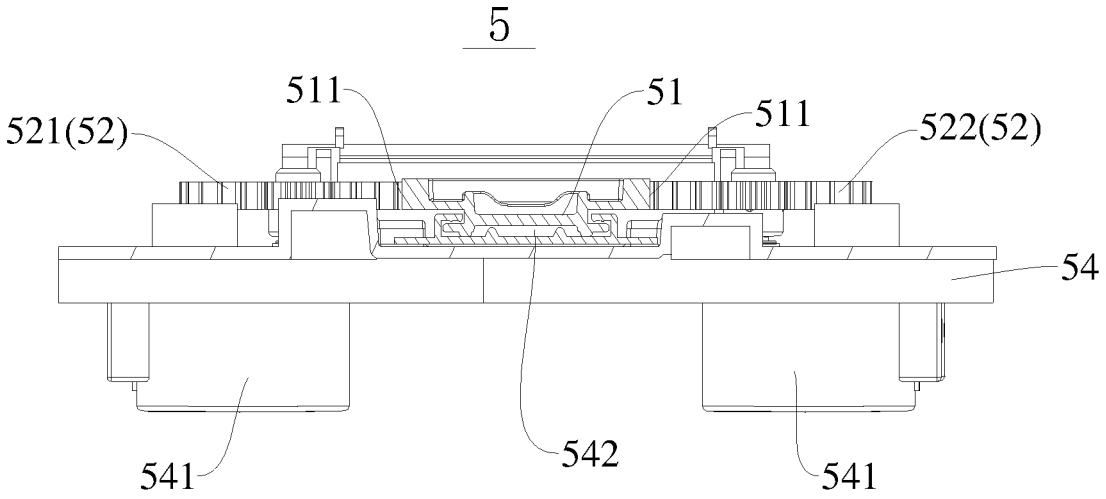
FIG. 8 is a bottom view of the driving mechanism in FIG. 6.

Further, as shown in FIG. 5, the two second sliding sub-grooves 32 are arranged between the two first sliding sub-grooves 31, and the two second sliding sub-grooves 32 are coupled to the two first sliding sub-grooves 31 in one-to-one correspondence. A length of the first sliding sub-grooves 31 and the second sliding sub-grooves 32 as a whole in the sliding direction of the door panel 2 is denoted as L; a length of the first sliding sub-grooves 31 in the sliding direction of the door panel 2 is denoted as L1; a length of the second sliding sub-grooves 32 in the sliding direction of the door panel 2 is denoted as L2, in which L is greater than L1 and L is greater than L2. Thus, the overall structure of the first sliding sub-grooves 31 and the second sliding sub-grooves 32 becomes compact, and an effective length for sliding guide of the door panel 2 can be increased, further improving the stability and reliability of the sliding of the door panel 2.

Further, as shown in FIG. 5, the first sliding sub-grooves 31 and the second sliding sub-grooves 32 extend in the up-down direction, with an upper end of each second sliding sub-groove 32 being lower than an upper end of each first sliding sub-groove 31 and a lower end of each second sliding sub-groove 32 being lower than a lower end of each first sliding sub-groove 31. Thus, the overall structure of the first sliding sub-grooves 31 and the second sliding sub-grooves 32 is simple and compact, and the effective length for sliding guide of the door panel 2 is increased; the stability and reliability of the sliding of the door panel 2 can be further improved.

Figure 9:
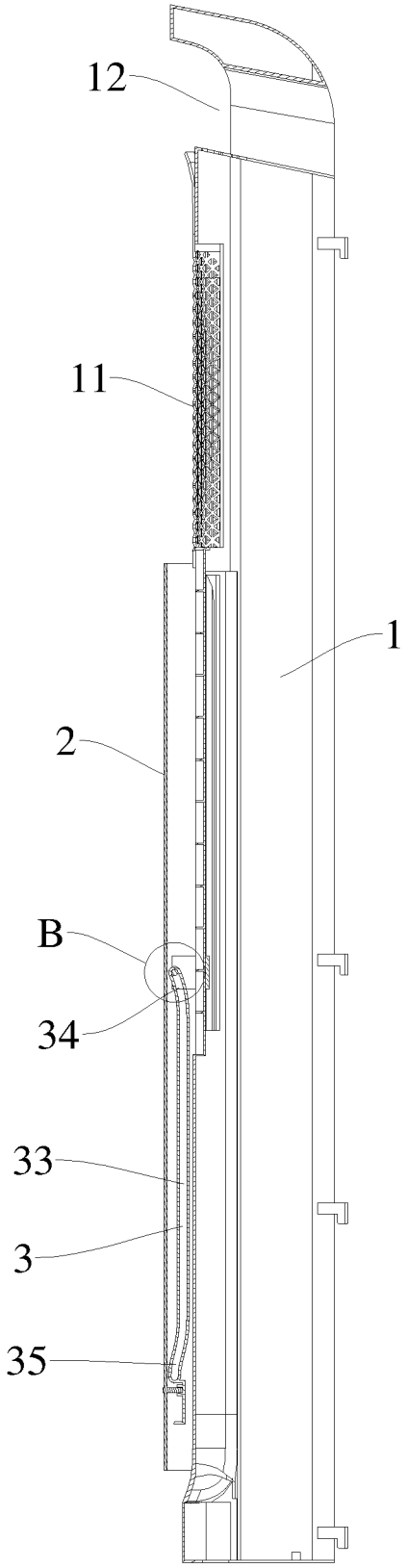
FIG. 9 is a sectional view of the air conditioner in FIG. 1.
Figure 10:
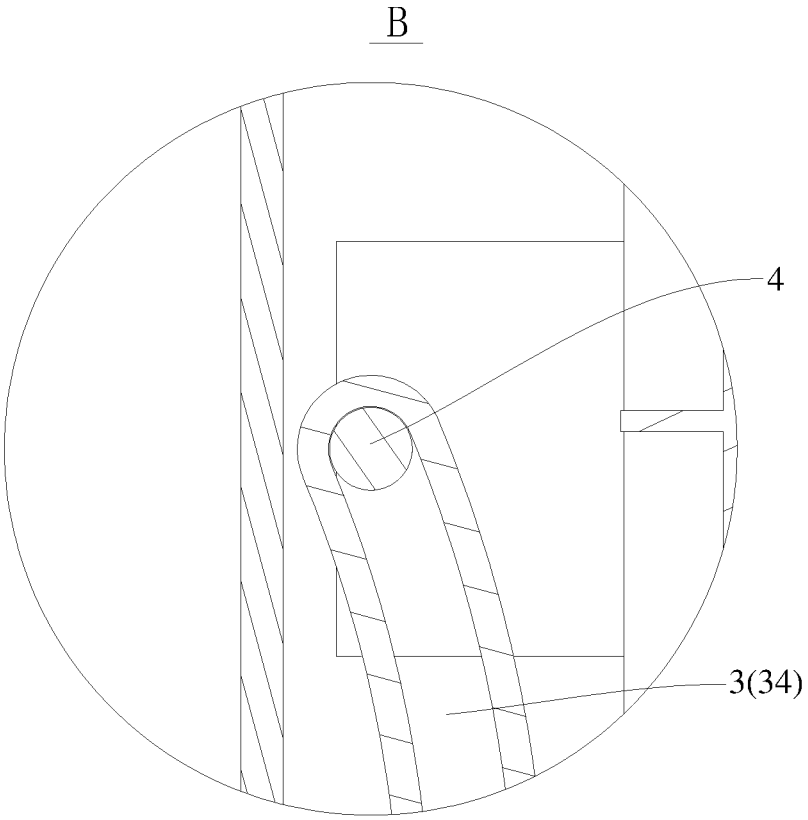
FIG. 10 is an enlarged view of a structure circled at B in FIG. 9.

In an embodiment of the present disclosure, as shown in FIGS. 5, 9 and 11, the sliding groove 3 includes a straight groove segment 33 and a first curved groove segment 34. A first end (a lower end as shown in FIGS. 5, 9 and 11) of the first curved groove segment 34 is coupled to a first end (an upper end as shown in FIGS. 5, 9 and 11) of the straight groove segment 33, and a second end (an upper end as shown in FIGS. 5, 9 and 11) of the first curved groove segment 34 is bent and extends in a direction away from the housing 1. The sliding groove 3 further includes a second curved groove segment 35, a first end (an upper end as shown in FIGS. 5, 9 and 11) of the second curved groove segment 35 being coupled to a second end (a lower end as shown in FIGS. 5, 9 and 11) of the straight groove segment 33, and a second end (a lower end as shown in FIGS. 5, 9 and 11) of the second curved groove segment 35 being bent and extending in a direction away from the housing 1. In some examples of the present disclosure, a distance of the first curved groove segment 34 along a direction perpendicular to the straight groove segment 33 is equal to a distance of the second curved groove segment 35 along a direction perpendicular to the straight groove segment 33.

When the door panel 2 is in a state of opening the front air outlet 11, as shown in FIGS. 1 and 9, the sliding shaft 4 fits in the first curved groove segment 34 and stops against an edge of the upper end of the first curved groove segment 34, and the door panel 2 fits on the housing 1, avoiding air leakage from a gap between the door panel 2 and the housing 1, effectively avoiding noise caused by air leakage, and reducing operation noise of the air conditioner 100. When the door panel 2 is in a state of closing the front air outlet 11, as shown in FIG. 12, the sliding shaft 4 fits in the second curved groove segment 35 and stops against an edge of the lower end of the second curved groove segment 35, and the door panel 2 fits on the housing 1, ensuring a gap-free fit between the door panel 2 and the housing 1, and preventing dust from entering the interior through the gap between the door panel 2 and the housing 1.

For example, when the door panel 2 moves from an open position shown in FIG. 1 towards a closed position shown in FIG. 12, i.e., when the door panel 2 moves from the bottom up, the sliding shaft 4 slides through the first curved groove segment 34, the straight groove segment 33, and the second curved groove segment 35 sequentially, and finally stops against the edge of the lower end of the second curved groove segment 35. When the sliding shaft 4 slides in the first curved groove segment 34, the door panel 2, under the guidance of the first curved groove segment 34, moves upwards and outwards (the term "outwards" herein means toward a direction away from the housing 1) for a distance equal to the distance of the first curved groove segment 34 along the direction perpendicular to the straight groove segment 33, so that the door panel 2 is spaced from the housing 1 by a certain gap. When the sliding shaft 4 moves to the straight groove segment 33, the door panel 2, under the guidance of the straight groove segment 33, moves vertically upwards and the gap between the door panel 2 and the housing 1 is maintained, effectively avoiding friction between the door panel 2 and the housing 1 and reducing noise during the sliding of the door panel 2. When the sliding shaft 4 moves into the second curved groove segment 35, the door panel 2, under the guidance of the second curved groove segment 35, moves upwards and inwards (the term "inwards" herein means toward a direction close to the housing 1) for a distance equal to the distance of the second curved groove segment 35 along the direction perpendicular to the straight groove segment 33, enabling the door panel 2 to fit on the housing 1 again when the door panel 2 completely closes the front air outlet 11, ensuring the gap-free fit between the door panel 2 and the housing 1, and preventing dust from entering the interior through the gap between them.

Conversely, when the door panel 2 moves from the closed position shown in FIG. 12 toward the open position shown in FIG. 1, i.e., when the door panel 2 moves from up to down, the sliding shaft 4 slides through the second curved groove segment 35, the straight groove segment 33 and the first curved groove segment 34 sequentially, and finally stops at the edge of the upper end of the first curved groove segment 34. When the sliding shaft 4 slides in the second curved groove segment 35, the door panel 2, under the guidance of the second curved groove segment 35, moves downwards and outwards (the term "outwards" herein means toward a direction away from the housing 1) for a distance equal to the distance of the second curved groove segment 35 along the direction perpendicular to the straight groove segment 33, so that the door panel 2 is spaced apart from the housing 1 by a certain gap. When the sliding shaft 4 moves to the straight groove segment 33, the door panel 2, under the guidance of the straight groove segment 33, moves vertically downwards and the gap between the door panel 2 and the housing 1 is maintained, effectively avoiding friction between the door panel 2 and the housing 1 and reducing noise during the sliding of the door panel 2. When the sliding shaft 4 moves into the first curved groove segment 34, the door panel 2, under the guidance of the first curved groove segment 34, moves downwards and inwards (the term "inwards" herein means toward a direction close to the housing 1) for a distance equal to the distance of the first curved groove segment 34 along the direction perpendicular to the straight groove segment 33, enabling the door panel 2 to fit on the housing 1 again when the door panel 2 completely opens the front air outlet 11, ensuring the gap-free fit between the door panel 2 and the housing 1, avoiding air leakage from the gap between the door panel 2 and the housing 1, effectively avoiding strange noise caused by air leakage, and reducing operation noise of the air conditioner 100.

In some examples of the present disclosure, the above-mentioned sliding shaft 4 can be integrally molded on the housing 1, improving the connection strength between the sliding shaft 4 and the housing 1. Alternatively, in some examples of the present disclosure, the above-mentioned sliding shaft 4 and the housing 1 are of a split structure, and the sliding shaft 4 is separately molded and can be subsequently coupled to the housing 1. As shown in FIG. 5, and the sliding shaft 4 is arranged on a mounting base 43, and the mounting base 43 is coupled to the housing 1 by a threaded fastener.

In some examples of the present disclosure, the above-mentioned sliding groove 3 can be integrally molded on the door panel 2. Alternatively, in some examples of the present disclosure, the above-mentioned sliding groove 3 and the door panel 2 are of a split structure, and the sliding groove 3 is separately molded and can be subsequently coupled to the door panel 2. As shown in FIG. 5, the sliding groove 3 is coupled to the door panel 2 by a threaded fastener.

In an embodiment of the present disclosure, as shown in FIGS. 5-8, a driving mechanism 5 is arranged between the housing 1 and the door panel 2 and drives the door panel 2 to slide. The driving mechanism 5 includes a rack 51, a gear 52, and a driving motor 53, the rack 51 engaging the gear 52. The rack 51 extends along the sliding direction of the door panel 2 and is coupled to the door panel 2; the gear 52 is coupled to the housing 1; and the driving motor 53 is coupled to the gear 52 to drive the gear 52 to rotate. Through the engagement between the rack 51 and the gear 52, the door panel 2 is driven to slide. The driving mechanism 5 has a simplified structure, and the driving process is stable and reliable.

Further, as shown in FIGS. 5-8, both sides of the rack 51 each include an engagement portion 511; the gear 52 includes a first gear 521 and a second gear 522 arranged on both sides of the rack 51; and the first gear 521 and the second gear 522 are engaged with their corresponding engagement portions 511, respectively. Thus, the fit between the rack 51 and the gear 52 becomes more stable and reliable.

In some examples of the present disclosure, as shown in FIGS. 5-8, the driving mechanism 5 also includes a support frame 54 coupled to the housing 1. The support frame 54 has a motor mounting position 541, and the driving motor 53 is mounted in the motor mounting position 541. The support frame 54 includes a limit slot 542, and the rack 51 is slidably fitted in the limit slot 542. By providing the support frame 54, the connection between the driving mechanism 5 and the housing 1 can be facilitated. By providing the limit slot 542 for engagement with the rack 51 on the support frame 54, the rack 51 can be limited in a direction perpendicular to a movement direction of the rack 51 when the door panel 2 slides, to prevent the rack 51 from shaking in a process of moving up and down and to make the movement process of the rack 51 more smoothly. In some examples of the present disclosure, a fit gap between the rack 51 and the limit slot 542 is less than or equal to 0.2 mm.

In some examples of the present disclosure, as shown in FIGS. 5-8, the driving mechanism 5 is located on an inner side of the housing 1, and the housing 1 includes a window 13 that runs through the housing 1 in a thickness direction of the housing 1. The door panel 2 is coupled to the driving mechanism 5 through the window 13. By arranging the driving mechanism 5 on the inner side of the housing 1, the overall structure of the air conditioner 100 becomes more compact, and the external structure of the air conditioner 100 is aesthetically pleasing. Further, the door panel 2 is configured to seal the window 13 by default, i.e., whether the door panel 2 opens the front air outlet 11 (as shown in FIG. 1) or closes the front air outlet 11 (as shown in FIG. 12), the door panel 2 seals the window 13, which ensures the aesthetic appearance of the overall external structure of the air conditioner 100.

In examples shown in FIGS. 5, 9 and 11, the sliding groove 3 includes a straight groove segment 33, a first curved groove segment 34, and a second curved groove segment 35. A first end (a lower end as shown in FIGS. 5, 9 and 11) of the first curved groove segment 34 is coupled to a first end (an upper end as shown in FIGS. 5, 9 and 11) of the straight groove segment 33, and a second end (an upper end as shown in FIGS. 5, 9 and 11) of the first curved groove segment 34 is bent and extends in a direction away from the housing 1. A first end (an upper end as shown in FIGS. 5, 9 and 11) of the second curved groove segment 35 is coupled to a second end (a lower end as shown in FIGS. 5, 9 and 11) of the straight groove segment 33, and a second end (a lower end as shown in FIGS. 5, 9 and 11) of the second curved groove segment 35 is bent and extends in a direction away from the housing 1. The driving mechanism 5 also includes a connecting member 55 articulated between the door panel 2 and the rack 51. When the sliding shaft 4 is slidingly fitted in the first curved groove segment 34 and the second curved groove segment 35, the connecting member 55 makes a corresponding rotation around an articulated shaft articulated to the rack 51, to adjust a distance between the rack 51 and the door panel 2, adapting to a change in a distance between the housing 1 and the door panel 2.

In the description of the present disclosure, it is to be understood that terms such as "central," "longitudinal," "transverse," "length," "thickness," "upper," "lower," "front," "rear," "left," "right," "vertical," "horizontal," "top," "bottom," "inner," "outer," "clockwise," "counter-clockwise," "axial," "radial," "circumferential" and the like should be construed to refer to orientations or positions as then described or as shown in the drawings under discussion. These relative terms are for convenience of description and do not indicate or imply that the device or element referred to must have a particular orientation or be constructed or operated in a particular orientation. Thus, these terms shall not be construed as limitations on the present disclosure.

In the description of the present disclosure, it should be understood that, unless specified or limited otherwise, the terms "mounted," "connected," and "coupled" are used broadly, and may be, for example, fixed connections, detachable connections, or integral connections; may also be mechanical or electrical connections; may also be direct connections or indirect connections via intervening structures; may also be inner communication or mutual interaction of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an exemplary embodiment," "an example," "a specific example" or "some examples" means that a particular feature, structure, material, or characteristic described in connection with the embodiment or example is included in at least one embodiment or example of the present disclosure. Thus, the appearances of the phrases throughout this specification are not necessarily referring to the same embodiment or example of the present disclosure. Furthermore, the particular features, structures, materials, or characteristics may be combined in any suitable manner in one or more embodiments or examples.

Although embodiments of the present disclosure have been shown and described, it would be appreciated by those skilled in the art that changes, modifications, alternatives, and variations can be made in the embodiments without departing from principles and purposes of the present disclosure. The scope of the present disclosure is defined by the claims and their equivalents.

What is claimed is:

1. An air conditioner comprising:

a housing comprising a front air outlet, the front air outlet comprising a first air outlet and a second air outlet;

a door panel slidably arranged on an outer side of the housing; and a driving mechanism configured to drive the door panel to slide, wherein there is at least one position where the door panel partially shields a part of the first air outlet and a part of the second air outlet simultaneously;

wherein the driving mechanism comprises:

a rack and a gear engaging each other, the rack extending along a sliding direction of the door panel and being coupled to the door panel, and the gear being coupled to the housing; and a driving motor coupled to the gear and configured to drive the gear to rotate;

wherein both sides of the rack each comprise an engagement portion;

wherein the gear comprises a first gear and a second gear arranged on a respective side of the rack; and wherein the first gear and the second gear are each engaged with a respective engagement portion.

2. The air conditioner according to claim 1, wherein the door panel comprises a sliding groove, the housing comprises a sliding shaft slidably fitted in the sliding groove.

3. The air conditioner according to claim 2, wherein:

the sliding groove comprise two first sliding sub-grooves and two second sliding sub-grooves, the two first sliding sub-grooves are spaced apart from each other on the door panel and have opposite opening directions, and the two second sliding sub-grooves are spaced apart from each other on the door panel and have opposite opening directions; and the sliding shaft comprises two first sliding sub-shafts and two second sliding sub-shafts, the two first sliding sub-shafts are spaced apart from each other on the housing and fitted in the two first sliding sub-grooves in one-to-one correspondence, and the two second sliding sub-shafts are spaced apart from each other on the housing and fitted in the two second sliding sub-grooves in one-to-one correspondence.

4. The air conditioner according to claim 3, wherein:

the two second sliding sub-grooves are arranged between the two first sliding sub-grooves, and the two second sliding sub-grooves are coupled to the two first sliding sub-grooves in one-to-one correspondence; and a length of the first sliding sub-grooves and the second sliding sub-grooves as a whole in a sliding direction of the door panel is L, a length of the first sliding sub-grooves in the sliding direction of the door panel is L1, and a length of the second sliding sub-grooves in the sliding direction of the door panel is L2, wherein L is greater than L1 and L is greater than L2.

5. The air conditioner according to claim 4, wherein the first sliding sub-grooves and the second sliding sub-grooves extend in an up-down direction, with an upper end of each second sliding sub-groove being lower than an upper end of each first sliding sub-groove and a lower end of each second sliding sub-groove being lower than a lower end of each first sliding sub-groove.

6. The air conditioner according to claim 2, wherein:

the sliding groove comprises a straight groove segment and a first curved groove segment, a first end of the first curved groove segment being coupled to a first end of the straight groove segment, and a second end of the first curved groove segment being bent and extending in a direction away from the housing; and the sliding groove further comprises a second curved groove segment, a first end of the second curved groove segment being coupled to a second end of the straight groove segment, and a second end of the second curved groove segment being bent and extending in the direction away from the housing.

7. The air conditioner according to claim 3, wherein:

the sliding groove comprises a straight groove segment and a first curved groove segment, a first end of the first curved groove segment being coupled to a first end of the straight groove segment, and a second end of the first curved groove segment being bent and extending in a direction away from the housing; and the sliding groove further comprises a second curved groove segment, a first end of the second curved groove segment being coupled to a second end of the straight groove segment, and a second end of the second curved groove segment being bent and extending in the direction away from the housing.

8. The air conditioner according to claim 1, wherein:

the driving mechanism further comprises a support frame coupled to the housing;

the support frame has a motor mounting position, and the driving motor is mounted in the motor mounting position; and the support frame comprises a limit slot, and the rack is slidably fitted in the limit slot.

9. The air conditioner according to claim 1, wherein:

the driving mechanism is located on an inner side of the housing;

the housing comprises a window, and the window extends through the housing in a thickness direction of the housing; and the door panel is coupled to the driving mechanism through the window, and the door panel is configured to seal the window.

10. The air conditioner according to claim 1, wherein:

the sliding groove comprises a straight groove segment and a first curved groove segment, a first end of the first curved groove segment being coupled to a first end of the straight groove segment, and a second end of the first curved groove segment being bent and extending in a direction away from the housing; and the driving mechanism further comprises a connecting member articulated between the door panel and the rack.

11. An air conditioner comprising:

a housing comprising a front air outlet, the front air outlet comprising a first air outlet and a second air outlet; and a door panel slidably arranged on an outer side of the housing, wherein there is at least one position where the door panel shields a part of the first air outlet and a part of the second air outlet simultaneously;

wherein the door panel comprises two first sliding sub-grooves and two second sliding sub-grooves, the two first sliding sub-grooves are spaced apart from each other on the door panel and have opposite opening directions, and the two second sliding sub-grooves are spaced apart from each other on the door panel and have opposite opening directions;

wherein the housing comprises two first sliding sub-shafts and two second sliding sub-shafts, the two first sliding sub-shafts are spaced apart from each other on the housing and fitted in the two first sliding sub-grooves in one-to-one correspondence, and the two second sliding sub-shafts are spaced apart from each other on the housing and fitted in the two second sliding sub-grooves in one-to-one correspondence;

wherein the two second sliding sub-grooves are arranged between the two first sliding sub-grooves, and the two second sliding sub-grooves are coupled to the two first sliding sub-grooves in one-to-one correspondence; and a length of the first sliding sub-grooves and the second sliding sub-grooves as a whole in a sliding direction of the door panel is L, a length of the first sliding sub-grooves in the sliding direction of the door panel is L1, and a length of the second sliding sub-grooves in the sliding direction of the door panel is L2, wherein L is greater than L1 and L is greater than L2.

* * * * *